US007518309B2

(12) United States Patent
Kim et al.

(10) Patent No.: US 7,518,309 B2
(45) Date of Patent: Apr. 14, 2009

(54) PLASMA DISPLAY PANEL

(75) Inventors: Se-Jong Kim, Suwon-si (KR); Seok-Gyun Woo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/970,816

(22) Filed: Oct. 20, 2004

(65) Prior Publication Data

US 2005/0088094 A1 Apr. 28, 2005

(30) Foreign Application Priority Data

Oct. 23, 2003 (KR) ..... 10-2003-0074272

(51) Int. Cl.
*H01J 17/49* (2006.01)

(52) U.S. Cl. ..... 313/582; 313/584

(58) Field of Classification Search ..... 313/582–587; 315/169.1–169.3; 445/23–25; 345/60
See application file for complete search history.

(56) References Cited

U.S. PATENT DOCUMENTS

| | | | | |
|---|---|---|---|---|
| 6,376,986 | B1 * | 4/2002 | Takagi et al. | 313/582 |
| 6,495,957 | B2 | 12/2002 | Kurogi et al. | |
| 6,522,072 | B1 * | 2/2003 | Hashimoto et al. | 313/582 |
| 7,327,083 | B2 * | 2/2008 | Woo et al. | 313/587 |
| 2004/0113555 | A1 * | 6/2004 | Han et al. | 313/586 |

FOREIGN PATENT DOCUMENTS

| | | |
|---|---|---|
| JP | 9-283032 | 10/1997 |
| JP | 11-96921 | 4/1999 |
| JP | 2001-297703 | 10/2001 |
| JP | 2001-345054 | 12/2001 |
| KR | 2000-0028556 | 5/2000 |

(Continued)

OTHER PUBLICATIONS

Korean Patent Abstracts, Publication No. 1020000028556; Publication Date May 25, 2000; in the name of Gadayama et al.

(Continued)

*Primary Examiner*—Joseph L Williams
(74) *Attorney, Agent, or Firm*—Christie, Parker & Hale, LLP

(57) ABSTRACT

A plasma display panel includes first and second substrates opposing one another. Address electrodes are formed on the first substrate in a first direction. Barrier ribs are mounted between the first and second substrates defining non-discharge regions and discharge cells, and phosphor layers are formed within the discharge cells. Discharge sustain electrodes are formed on the second substrate in a second direction substantially perpendicular to the first direction. The non-discharge regions are formed in areas encompassed by discharge cell abscissas and ordinates that pass through centers of adjacent discharge cells. The discharge sustain electrodes include bus electrodes that extend such that a pair of the bus electrodes is provided for each of the discharge cells, and protrusion electrodes formed extending from each of the bus electrodes such that a pair of opposing protrusion electrodes is formed in each discharge cell. Also, a predetermined angle is formed between proximal ends of the protrusion electrodes and inner surfaces of the barrier ribs opposing the proximal ends.

12 Claims, 4 Drawing Sheets

FOREIGN PATENT DOCUMENTS

| | | |
|---|---|---|
| KR | 2000-0076895 | 12/2000 |
| KR | 2003-0042538 | 6/2003 |

OTHER PUBLICATIONS

Korean Patent Abstracts, Publication No. 1020000076895; Publication Date Dec. 26, 2000; in the name of Kosaka et al.
Korean Patent Abstracts, Publication No. 1020030042538; Publication Date Jun. 2, 2003; in the name of Min.
Patent Abstracts of Japan, Publication No. 09-283032; Date of Publication: Oct. 31, 1997; in the name of Seiichi Tsuchida et al.
Patent Abstracts of Japan, Publication No. 11-096921; Date of Publication: Apr. 9, 1999; in the name of Tetsuyoshi Tomioka et al.
Patent Abstracts of Japan, Publication No. 2001-297703; Date of Publication: Oct. 26, 2001; in the name of Kimio Amamiya et al.
Patent Abstracts of Japan, Publication No. 2001-345054; Date of Publication: Dec. 14, 2001; in the name of Ko Sano et al.

* cited by examiner

PLASMA DISPLAY PANEL

CROSS-REFERENCE TO RELATED APPLICATION

This application claims priority to and the benefit of Korean Patent Application No. 10-2003-0074272, filed on Oct. 23, 2003 in the Korean Intellectual Property Office, the entire content of which is incorporated herein by reference.

BACKGROUND OF THE INVENTION (a) Field of the Invention

The present invention relates to a plasma display panel (PDP), and more particularly, to a PDP in which the formation of discharge sustain electrodes is optimized.

(b) Description of the Related Art

A PDP is typically a display device in which ultraviolet rays generated by the discharge of gas excite phosphors to realize predetermined images. With its ability to realize high-resolution images, the PDP is emerging as one of the most popular flat panel display configurations used for wall-mounted televisions and other similar large-screen applications.

In the conventional triode surface discharge AC-PDP, address electrodes are formed on a rear substrate corresponding to the positioning of discharge cells. Sustain electrodes comprised of scan electrodes and common electrodes are formed on a front substrate. Also, red, green, and blue phosphor layers are formed within each of the discharge cells, and the discharge cells are filled with discharge gas (typically an Ne—Xe compound gas). The discharge cells are defined by barrier ribs, which are generally formed in a striped pattern or in a closed lattice configuration.

An address voltage Va is applied between the address electrodes and the scan electrodes to select discharge cells where illumination is to take place. Also, a sustain voltage Vs is applied between the scan electrodes and common electrodes of selected discharge cells such that plasma discharge (i.e., sustain discharge) occurs in the discharge cells. As a result, vacuum ultraviolet rays are emitted from excited Xe atoms generated during sustain discharge. The vacuum ultraviolet rays excite the phosphor layers of the corresponding discharge cells so that visible light is created to thereby realize the display of color images.

In the PDP operating as described above, the sustain electrodes perform the function of effecting sustain discharge in the discharge cells. Therefore, the formation of the sustain electrodes greatly affects discharge efficiency. The formation of the sustain electrodes generally is determined by the shape of the discharge cells, which are defined by the barrier ribs. As a result, much careful consideration is required with respect to forming the barrier ribs and sustain electrodes so that optimal discharge efficiency may be achieved.

However, this is generally not the case, and it is common practice to form the barrier ribs and sustain electrodes with the goal of simplifying design and manufacture. This often results in poor illumination efficiency. That is, if the barrier ribs and sustain electrodes are formed without considering the affect on discharge efficiency, the PDP becomes inefficient in its use of discharge current and wall charges such that there is a significant reduction in overall panel efficiency (i.e., brightness ratio relative to the amount of power consumed).

SUMMARY OF THE INVENTION

In one exemplary embodiment of the present invention, there is provided a plasma display panel in which the formation of discharge sustain electrodes is optimized to thereby improve screen brightness and discharge efficiency.

A plasma display panel includes a first substrate and a second substrate provided opposing one another with a predetermined gap therebetween; address electrodes formed in a first direction on a surface of the first substrate opposing the second substrate; barrier ribs mounted between the first and second substrates defining non-discharge regions and discharge cells; phosphor layers formed within each of the discharge cells; and discharge sustain electrodes formed in a second direction on a surface of the second substrate opposing the first substrate, the second direction being substantially perpendicular to the first direction.

The non-discharge regions are formed in areas encompassed by discharge cell abscissas that pass through centers of adjacent second direction discharge cells and discharge cell ordinates that pass through centers of adjacent first direction discharge cells. The discharge sustain electrodes include bus electrodes that extend such that a pair of the bus electrodes are provided for each of the discharge cells and are positioned at outer areas of the discharge cells, and protrusion electrodes are formed extending from each of the bus electrodes such that a pair of opposing protrusion electrodes are formed within areas corresponding to each discharge cell. Also, an angle θ between proximal ends of the protrusion electrodes and inner surfaces of the barrier ribs opposing the proximal ends of the protrusion electrodes members is set to a predetermined level.

The proximal ends of the protrusion electrodes gradually decrease in width in the second direction as the bus electrodes are approached.

The protrusion electrodes are formed substantially corresponding to inner areas of the discharge cells.

The angle θ satisfies the condition, $$0° < \theta \leqq 45°.$$

Each of the discharge cells is formed such that ends of the discharge cells gradually decrease in width along the second direction as a distance from a center of the discharge cells is increased along the first direction.

A depth of ends of the discharge cells along the first direction is less than a depth at center areas of the discharge cells, with the depth of the discharge cells reducing as a distance from the centers thereof is increased along the first direction.

The barrier ribs include first barrier rib members substantially parallel to the address electrodes, and second barrier rib members formed at a predetermined angle to the first barrier rib members and intersecting the first barrier rib members over the address electrodes.

The second barrier rib members are formed substantially in the shape of an "X" between discharge cells adjacent in the first direction.

An angle θ between proximal ends of the protrusion electrodes and inner surfaces of the second barrier rib members is in the range of 0-45°.

For each pair of opposing protrusion electrodes, a short gap is formed between the opposing protrusion electrodes at areas corresponding to exterior areas of the particular discharge cell, and a long gap is formed between the opposing protrusion electrodes at an area corresponding to a center area of the particular discharge cell. A distal end of each of the opposing protrusion electrodes opposite proximal ends connected to and extended from the bus electrodes is formed including an indentation at a center area along the second direction.

DETAILED DESCRIPTION

Figure 1:
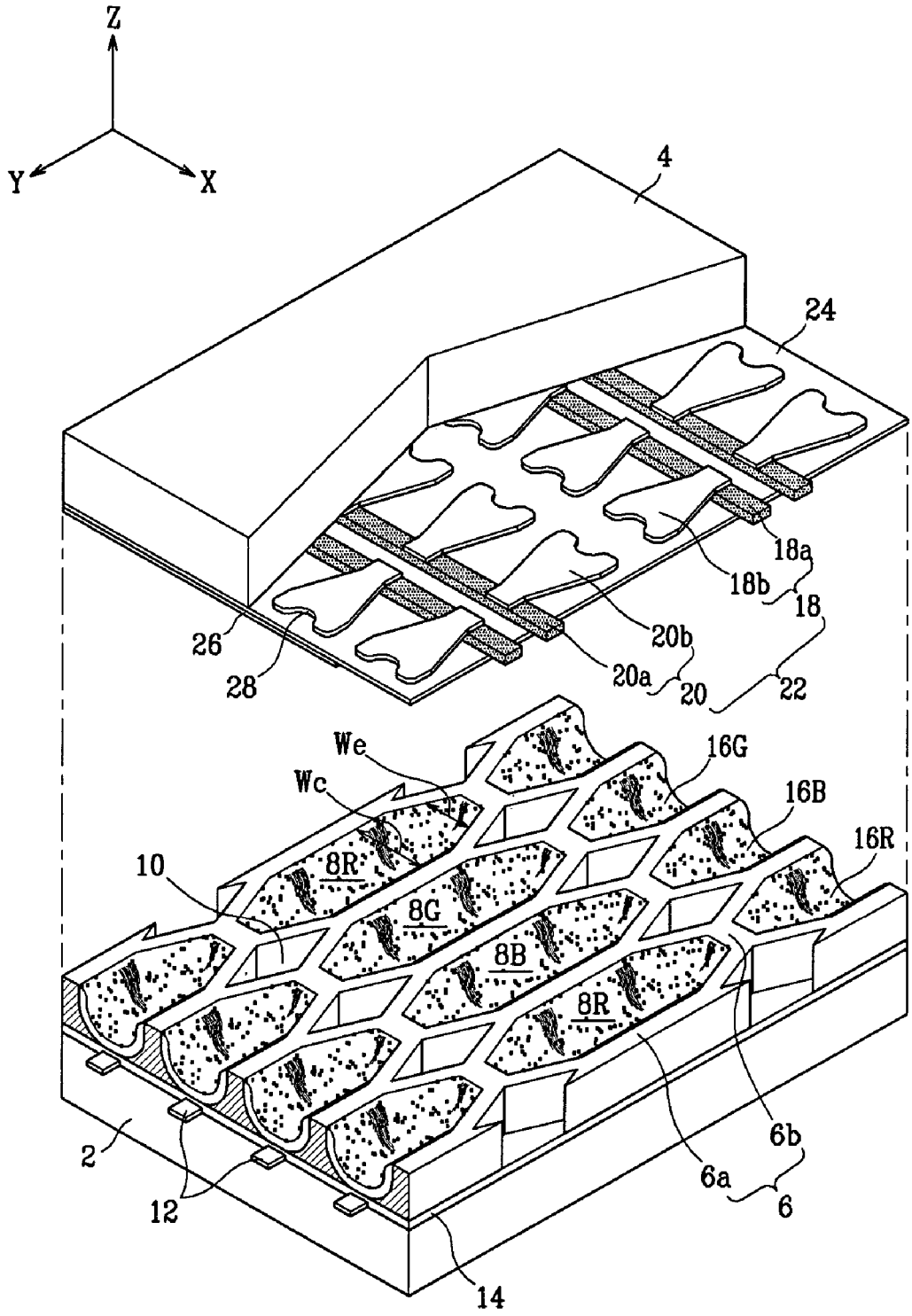
FIG. 1 is a partial exploded perspective view of a plasma display panel according to an exemplary embodiment of the present invention.
Figure 2:
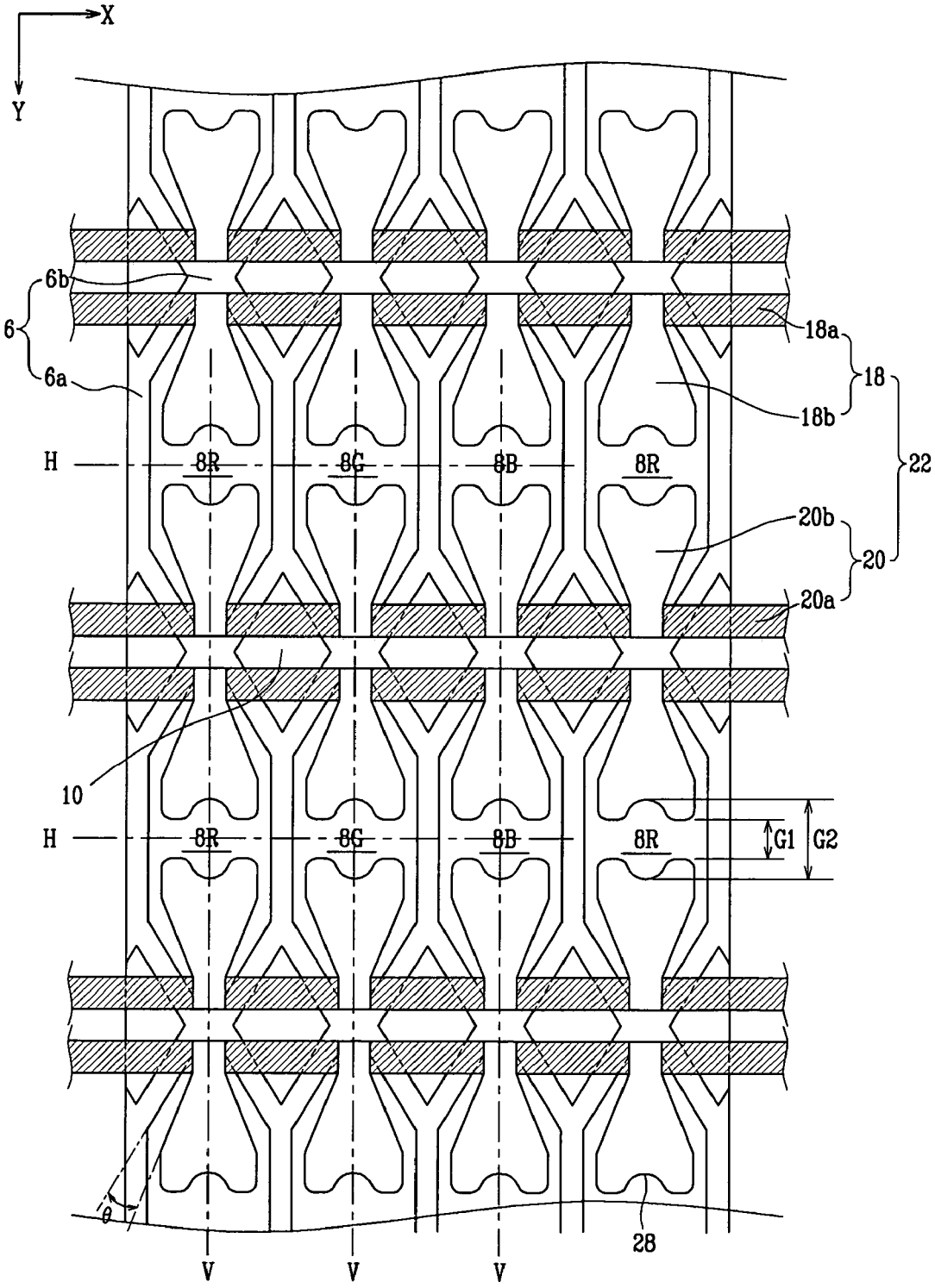
FIG. 2 is a partial plan view of the plasma display panel of FIG. 1 in an assembled state.
Figure 3:
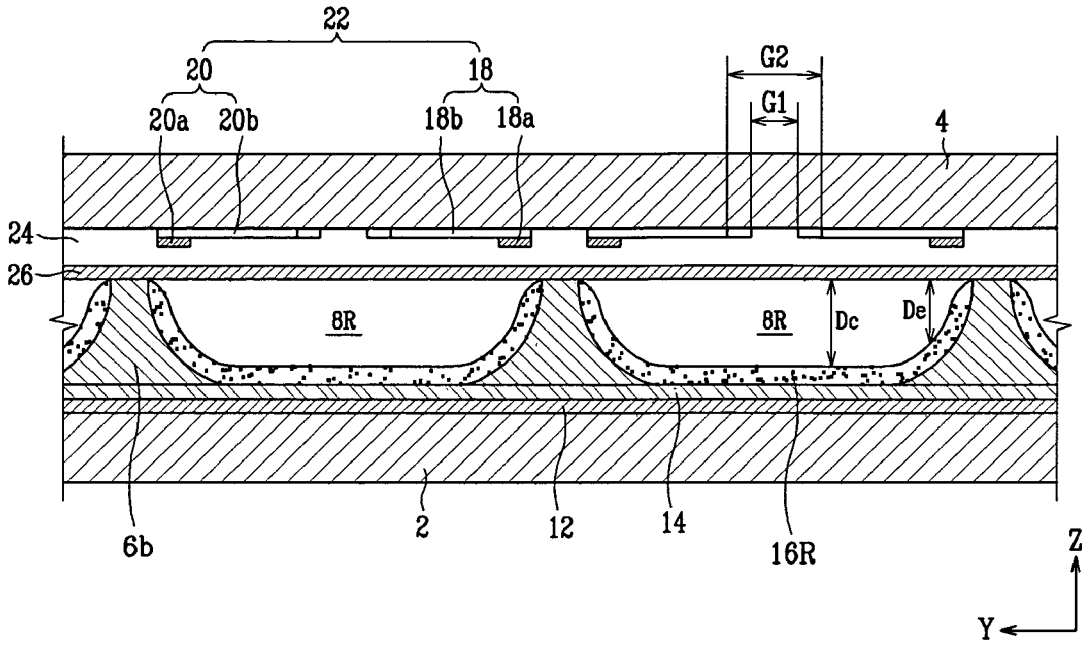
FIG. 3 is a partial sectional view of the plasma display panel of FIG. 1 in an assembled state.

Referring to FIGS. 1-3, in the PDP of an exemplary embodiment of the present invention, first substrate 2 and second substrate 4 are provided opposing one another with a predetermined gap therebetween. Non-discharge regions 10 and discharge cells 8R, 8G, 8B are defined by barrier ribs 6 in the gap between the first and second substrates 2, 4.

Address electrodes 12 are formed on an inner surface of first substrate 2 opposing second substrate 4. Address electrodes 12 are formed along one direction (direction Y). As an example, address electrodes 12 are formed in a striped pattern with predetermined spacing between adjacent address electrodes 12. First dielectric layer 14 is formed over an entire inner surface of first substrate 2 covering address electrodes 12.

Barrier ribs 6 are formed on first dielectric layer 14. Barrier ribs 6 define non-discharge regions 10 and discharge cells 8R, 8G, 8B as described above. Discharge cells 8R, 8G, 8B are spaces where gas discharge and illumination occur, while non-discharge regions 10 are spaces where gas discharge and illumination are not expected to take place. In this exemplary embodiment, non-discharge regions 10 and discharge cells 8R, 8G, 8B are formed as independent units.

Barrier ribs 6 define discharge cells 8R, 8G, 8B along direction Y of address electrodes 12, and along the direction substantially perpendicular (direction X) to address electrodes 12. Discharge cells 8R, 8G, 8B are defined by barrier ribs 6 in a manner to optimize the spread of discharge gas.

In particular, the areas of the discharge cells 8R, 8G, 8B that minimally affect sustain discharge and brightness are reduced in size. This is realized by each of discharge cells 8R, 8G, 8B being formed with ends that reduce in width in direction X as a distance from a center of each of the discharge cells 8R, 8G, 8B is increased in direction Y.

That is, as shown in FIG. 1, width Wc of a mid-portion of discharge cells 8R, 8G, 8B is greater than width We of the ends of discharge cells 8R, 8G, 8B, with width We of the ends decreasing up to a certain point as the distance from the center of discharge cells 8R, 8G, 8B is increased. Therefore, the ends of discharge cells 8R, 8G, 8B are formed in the shape of a trapezoid (with its end removed) until reaching a predetermined location where barrier ribs 6 close off discharge cells 8R, 8G, 8B. This results in each of discharge cells 6R, 6G, 6B having an overall planar shape of an octagon.

As seen in FIG. 2, non-discharge regions 10 defined by barrier ribs 6 are formed in areas encompassed by discharge cell abscissas H and ordinates V that pass through centers of each of discharge cells 8R, 8G, 8B, and that are respectively aligned with direction X and direction Y. In one embodiment, non-discharge regions 10 are centered between adjacent abscissas H and adjacent ordinates V. Stated differently, in one embodiment each pair of discharge cells 8R, 8G, 8B adjacent to one another along direction X has a common non-discharge region 10 with another such pair of discharge cells 8R, 8G, 8B adjacent along direction Y. With this configuration realized by barrier ribs 6, each of non-discharge regions 10 has an independent cell structure.

Barrier ribs 6 defining non-discharge regions 10 and discharge cells 8R, 8G, 8B in the manner described above include first barrier rib members 6*a* that are parallel to address electrodes 12, and second barrier rib members 6*b* that define the ends of discharge cells 8R, 8G, 8B as described above and are not parallel to address electrodes 12. In the third embodiment, second barrier rib members 6*b* are formed extending up to a point at a predetermined angle to first barrier rib members 6*a*, then extending in the direction substantially perpendicular to address electrodes 12 to cross over address electrodes 12. Therefore, second barrier rib members 6*b* are formed in substantially an X shape between discharge cells 8R, 8G, 8B adjacent along the direction of address electrodes 12.

Phosphor layers 16R, 16G, 16B on which red, green, and blue phosphors, respectively, are deposited cover all inner surfaces of discharge cells 8R, 8G, 8B, respectively.

Referring now to FIG. 3, a depth from an upper exposed surface of phosphor layers 16R, 16G, 16B to MgO protection layer 26 decreases as a distance from the center of each of discharge cells 8R, 8G, 8B is increased in direction Y. That is, using discharge cells 8R in FIG. 3 as an example, depth De at the ends of discharge cells 8R along direction Y is less than depth De at center areas of discharge cells 8R, with depth De steadily decreasing as a distance from the centers of discharge cells 8R is increased. Such a configuration is used also for green discharge cells 8G and blue discharge cells 8B.

Formed on a surface of second substrate 4 facing first substrate 2 and along direction X are sustain electrodes 22. Sustain electrodes 22 include scan electrodes 18 and common electrodes 20. A transparent second dielectric layer 24 is formed over an entire inner surface of second substrate 4 covering sustain electrodes 22, and MgO protection layer 26 is formed covering second dielectric layer 24.

Scan electrodes 18 and common electrodes 20 include bus electrodes 18*a*, 20*a*, respectively, formed in a striped pattern and in a direction substantially perpendicular to address electrodes 12. Bus electrodes 18*a*, 20*a* extend along opposite ends of each row of discharge cells 8R, 8G, 8B formed along the direction perpendicular to address electrodes 12. Scan electrodes 18 and common electrodes 20 also include protrusion electrodes 18*b*, 20*b*, respectively. Protrusion electrodes 18*b*, 20*b* are formed such that for each of discharge cells 8R, 8G, 8B there is one protrusion electrode 18*b* extending into the particular discharge cell 6R, 6G, 6B from the corresponding bus electrode 18*a*, and one protrusion electrode 20*b* extending into the particular discharge cell 6R, 6G, 6B from the corresponding bus electrode 20*a*. Predetermined discharge gaps are formed between each opposing pair of protrusion electrodes 18*b*, 20*b* in each of the discharge cells 8R, 8G, 8B.

Distal ends of protrusion electrodes 18*b*, 20*b* are structured such that indentations 28 are formed in center areas along direction X. Therefore, in discharge cells 8R, 8G, 8B, short gap G1 and long gap G2 of different sizes are formed between opposing protrusion electrodes 18*b* and 20*b*. That is, long gaps G2 are formed where indentations 28 of protrusion electrodes 18*b*, 20*b* oppose one another, and short gaps G1 are formed where the protruded areas to both sides of indentations 28 of protrusion electrodes 18*b*, 20*b* oppose one another.

In addition, proximal ends of protrusion electrodes 18*b*, 20*b* are formed decreasing in width along direction X as a distance from the centers of discharge cells 8R, 8G, 8B is increased in the direction address electrodes 12 are provided (direction Y). In one embodiment, protrusion electrodes 18*b* and 20*b* are positioned fully within the areas corresponding to discharge cells 8R, 8G, 8B.

In one embodiment, bus electrodes 18*a*, 20*a* are made of an alloy of chrome (Cr) and copper (Cu), and protrusion electrodes 18*b*, 20*b* are made of a transparent material such as indium tin oxide (ITO).

Figure 4:
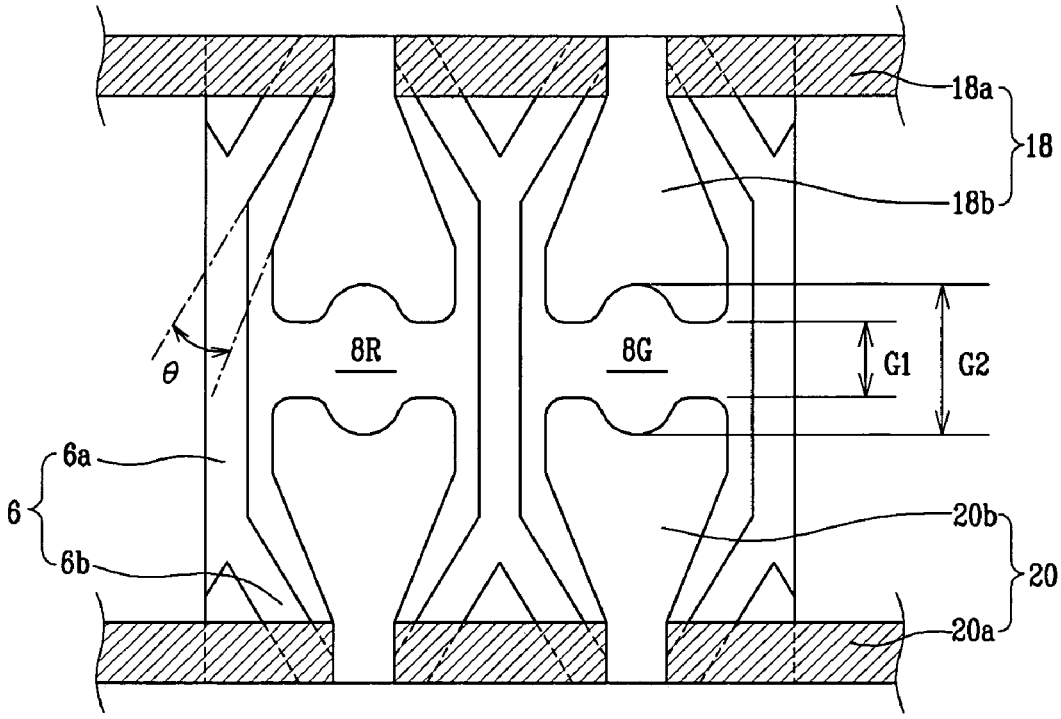
FIG. 4 is an enlarged view of a select area of FIG. 2.

With reference to FIG. 4, if a straight line is drawn along an inner surface of a section of one of the second barrier rib members 6*b* that is at a predetermined angle to the corresponding first barrier rib member 6*a*, and a straight line is drawn along the portion of the proximal end of protrusion electrode 18*b* adjacent to this section of second barrier rib member 6*b*, an angle θ between these two straight lines when they are extended until intersecting is set within a predetermined range. This results in an improvement in PDP efficiency (i.e., brightness ratio relative to the amount of power consumed) while ensuring sufficient screen brightness, and prevents mis-discharge between discharge cells 8R, 8G, 8B. In the exemplary embodiment, the angle θ is set as follows, $$0° < \theta \leqq 45°.$$

The structure as described above is applied to each of the protrusion electrodes 18*b*, 20*b*, and to each of the discharge cells 8R, 8G, 8B. First substrate 2 and second substrate 4 structured as described above are sealed using a frit along opposing edges. A discharge gas (typically an Ne—Xe compound gas) is filled in the PDP prior to sealing the same.

Using one of the red discharge cells 8R as an example to describe all of the discharge cells 8R, 8G, 8B, if an address voltage Va is applied between the corresponding address electrode 12 and scan electrode 18, address discharge occurs in discharge cell 8R. As a result of the address discharge is that a wall charge accumulates on second dielectric layer 24 that covers sustain electrodes 22 to thereby select discharge cell 8R.

Next, a sustain voltage Vs is applied between scan electrode 18 and common electrode 20 of selected discharge cell 8R. As a result, plasma discharge (i.e., sustain discharge) occurs starting in the discharge gap between opposing protrusion electrodes 18*b*, 20*b*. The plasma discharge then spreads to peripheries of discharge cell 8R. Vacuum ultraviolet rays are emitted from the excited Xe atoms created during plasma discharge, and the vacuum ultraviolet rays excite phosphor layer 16R of discharge cell 8R so that it emits visible light. Predetermined images are realized by performing this operation in a deliberate, selective manner over the entire PDP.

Following the spread of the plasma discharge, which is generated by the sustain voltage Vs in an arc configuration to peripheries of discharge cell 8R, it is distinguished. In the exemplary embodiment, each of the discharge cells 8R, 8G, 8B are formed as described above to optimize the spread of plasma discharge such that efficient sustain discharge occurs over the entire region of discharge cells 8R, 8G, 8B. This results in increased discharge efficiency.

Further, as a result of the cross-sectional configuration of discharge cells 8R, 8G, 8B described with reference to FIG. 3, the area of contact of phosphor layers 16R, 16G, 16B with respect to the discharge regions is steadily increased as the exteriors of discharge cells 8R, 8G, 8B are approached and traversed. This increases illumination efficiency. Therefore, PDP efficiency may be increased even with a reduction in the discharge regions by the formation of non-discharge regions 10.

In addition, by the formation of indentations 28 in protrusion electrodes 18*b*, 20*b*, plasma discharge starts first in short gaps G1, which correspond to exterior regions of discharge cells 8R, 8G, 8B, then spreads to peripheries. Plasma display also starts in long gaps G2 corresponding to center areas of discharge cells 8R, 8G, 8B, then spreads to peripheries of the same. Therefore, initial discharge of a greater intensity occurs over a greater area, thereby improving discharge efficiency.

Also, by setting the angle θ between the inner surfaces of second barrier rib members 6*b* and the portions of the proximal ends of protrusion electrode 18*b*, 20*b* adjacent to second barrier rib members 6*b* in the range of 0°-45° as described above, PDP efficiency is improved while ensuring sufficient screen brightness, and the frequency of mis-discharge is reduced. These results are based on measurements of efficiency, screen brightness, and mis-discharge frequency taken using various different angles between the two lines as described above.

Table 1 below lists data of measurements of screen brightness, PDP efficiency, and mis-discharge between adjacent discharge cells as a function of the angle θ as described above.

TABLE 1

| No. | Angle (°) | Brightness (cd/m$^2$) | Efficiency (lm/W) | Mis-discharge frequency |
|---|---|---|---|---|
| 1 | −15 | 117 | 0.87 | 8 |
| 2 | −12.5 | 108 | 0.89 | 9 |
| 3 | −10 | 108 | 0.88 | 7 |
| 4 | −7.5 | 105 | 0.92 | 5 |
| 5 | −5 | 106 | 0.94 | 6 |
| 6 | −2.5 | 102 | 0.91 | 5 |
| 7 | 0 | 100 | 1 | 2 |
| 8 | 2.5 | 101 | 1.04 | 2 |
| 9 | 5 | 98 | 1.02 | 2 |
| 10 | 7.5 | 99 | 1.02 | 1 |
| 11 | 10 | 96 | 1.05 | 1 |
| 12 | 12.5 | 98 | 1,09 | 0 |
| 13 | 15 | 97 | 1.07 | 0 |
| 14 | 17.5 | 95 | 1.08 | 0 |
| 15 | 20 | 96 | 1.09 | 0 |
| 16 | 22.5 | 96 | 1.1 | 0 |
| 17 | 25 | 94 | 1.14 | 0 |
| 18 | 27.5 | 92 | 1.19 | 0 |
| 19 | 30 | 93 | 1.21 | 0 |
| 20 | 32.5 | 91 | 1.21 | 0 |
| 21 | 35 | 91 | 1.20 | 0 |
| 22 | 37.5 | 89 | 1.15 | 0 |
| 23 | 40 | 90 | 1.14 | 0 |
| 24 | 42.5 | 90 | 1.11 | 0 |
| 25 | 45 | 88 | 1.05 | 0 |
| 26 | 47.5 | 80 | 1.07 | 0 |
| 27 | 50 | 81 | 1.02 | 0 |
| 28 | 52.5 | 78 | 0.98 | 0 |
| 29 | 55 | 78 | 0.92 | 1 |
| 30 | 57.5 | 77 | 0.90 | 1 |
| 31 | 60 | 77 | 0.91 | 1 |

From the table, it is clear that an angle of less than 0° (Nos. 1-6) is undesirable, since although a high brightness is obtained, PDP efficiency is low and there is a high frequency of mis-discharge. It is also clear that an angle that exceeds 45° (Nos. 26-32) is undesirable since screen brightness becomes very low and PDP efficiency is reduced.

Therefore, based on the results presented in Table 1, it is clear that the best results are obtained when the angle θ between the inner surfaces of second barrier rib members 6*b* and the portions of the proximal ends of protrusion electrode 18*b*, 20*b* adjacent to second barrier rib members 6*b* is in the range of 0°-45°. If this condition is satisfied, PDP efficiency is increased while ensuring sufficient screen brightness, and the frequency of mis-discharge is reduced. This is a result of ensuring sufficient space between second barrier rib members 6*b* and protrusion electrodes 18*b*, 20*b* such that wall charges generated at exterior areas of protrusion electrodes 18*b*, 20*b* do not receive interference from second barrier rib members 6*b*, such that they are fully utilized during sustain discharge so that the wall charges more fully contribute to discharge.

In the PDP of the present invention as described above, each of the discharge cells 8R, 8G, 8B are formed corresponding to the manner in which discharge is spread such that efficient sustain discharge occurs over the entire region of discharge cells 8R, 8G, 8B, and discharge efficiency is increased. Therefore, PDP efficiency may be increased even with a reduction in the discharge regions by the formation of the non-discharge regions 10.

Further, by setting the angle θ between the inner surfaces of second barrier rib members 6*b* and the portions of the proximal ends of protrusion electrode 18*b*, 20*b* adjacent to second barrier rib members 6*b* in the range of 0°-45°, PDP efficiency is improved while ensuring sufficient screen brightness, and the frequency of mis-discharge is reduced.

Although embodiments of the present invention have been described in detail hereinabove in connection with certain exemplary embodiments, it should be understood that the invention is not limited to the disclosed exemplary embodiments, but is intended to cover various modifications and/or equivalent arrangements included within the spirit and scope of the present invention, as defined in the appended claims.

What is claimed is:

1. A plasma display panel, comprising:

a first substrate and a second substrate provided opposing one another with a predetermined gap therebetween;

address electrodes extending in a first direction on a surface of the first substrate opposing the second substrate;

barrier ribs mounted between the first substrate and the second substrate defining non-discharge regions and discharge cells;

a phosphor layer formed within each of the discharge cells; and discharge sustain electrodes extending in a second direction on a surface of the second substrate opposing the first substrate, the second direction being substantially perpendicular to the first direction, wherein the non-discharge regions are formed in areas encompassed by discharge cell abscissas that pass through centers of adjacent second direction discharge cells and discharge cell ordinates that pass through centers of adjacent first direction discharge cells, wherein the discharge sustain electrodes include bus electrodes that extend such that a pair of the bus electrodes are provided for each of the discharge cells and positioned at outer areas of the discharge cells, and protrusion electrodes formed extending from each of the bus electrodes such that a pair of opposing protrusion electrodes are formed within areas corresponding to each discharge cell, theproximal ends of the protrusion electrodes tapering narrower in width in the second direction as the bus electrodes are approached in the first direction, wherein an angle θ between proximal ends of the protrusion electrodes and inner surfaces of the barrier ribs opposing the proximal ends of the protrusion electrodes is set to a predetermined level, wherein barrier ribs defining discharge cells intersect between non-discharge regions in the second direction adjacent the defined discharge cells, and wherein a depth of ends of the discharge cells along the first direction is less than a depth at center areas of the discharge cells, with the depth of the discharge cells reducing as a distance from the centers thereof is increased along the first direction.

2. The plasma display panel of claim 1, wherein the proximal ends of the protrusion electrodes gradually decrease in width in the second direction as the bus electrodes are approached.

3. The plasma display panel of claim 2, wherein the protrusion electrodes are formed substantially corresponding to inner areas of the discharge cells.

4. The plasma display panel of claim 1, wherein the angle θ satisfies the condition $$0° < \theta \leqq 45°.$$

5. The plasma display panel of claim 1, wherein each of the discharge cells is formed such that ends of the discharge cells gradually decrease in width along the second direction as a distance from a center of the discharge cells is increased along the first direction.

6. The plasma display panel of claim 1, wherein the barrier ribs include first barrier rib members substantially parallel to the address electrodes, and second barrier rib members formed at a predetermined angle to the first barrier rib members and intersecting the first barrier rib members over the address electrodes.

7. The plasma display panel of claim 6, wherein the second bamer rib members are formed substantially in the shape of an "X" between discharge cells adjacent in the first direction.

8. The plasma display panel of claim 6, wherein an angle θ between proximal ends of the protrusion electrodes and inner surfaces of the second barrier rib members is in the range of 0-45°.

9. The plasma display panel of claim 1, wherein for each pair of opposing protrusion electrodes, a short gap is formed between the opposing protrusion electrodes at areas corresponding to exterior areas of the particular discharge cell, and a long gap is formed between the opposing protrusion electrodes at an area corresponding to a center area of the particular discharge cell.

10. The plasma display panel of claim 1, wherein a distal end of each of the opposing protrusion electrodes opposite proximal ends connected to and extended from the bus electrodes is formed including an indentation at a center area along the second direction.

11. The plasma display panel of claim 9, wherein a distal end of each of the opposing protrusion electrodes opposite proximal ends connected to and extended from the bus electrodes is formed including an indentation at a center area along the second direction.

12. A plasma display panel, comprising:

a first substrate and a second substrate provided opposing one another with a predetermined gap therebetween;

address electrodes extending in a first direction on a surface of the first substrate opposing the second substrate;

barrier ribs mounted between the first substrate and the second substrate defining non-discharge regions and discharge cells;

a phosphor layer formed within each of the discharge cells; and discharge sustain electrodes extending in a second direction on a surface of the second substrate opposing the first substrate, the second direction being substantially perpendicular to the first direction, wherein the non-discharge regions are formed in areas encompassed by discharge cell abscissas that pass through centers of adjacent second direction discharge cells and discharge cell ordinates that pass through centers of adjacent first direction discharge cells, wherein the discharge sustain electrodes include bus electrodes that extend such that a pair of the bus electrodes are provided for each of the discharge cells and positioned at outer areas of the discharge cells, and protrusion electrodes formed extending from each of the bus electrodes such that a pair of opposing protrusion electrodes are formed within areas corresponding to each discharge cell, proximal ends of the protrusion electrodes tapering narrower in width in the second direction as the bus electrodes are approached in the first direction, wherein the discharge cells taper narrower in width in the second direction as the barrier ribs intersect between the non-discharge regions in the second direction adjacent the discharge cells, and wherein an angle $\theta$ between proximal ends of tapered portions of the protrusion electrodes and inner surfaces of tapered portions of the discharge cells opposing the proximal ends of the protrusion electrodes satisfies the condition $0° < \theta < 45°$.

* * * * *